US005929878A

United States Patent [19]

Pelletier

[11] Patent Number: 5,929,878

[45] Date of Patent: Jul. 27, 1999

[54] INK JET ASSEMBLY CAPILLARY CLEANING METHOD AND APPARATUS

[75] Inventor: Michael P. Pelletier, Tilton, N.H.

[73] Assignee: Improved Technology of New Hampshire, Tilton, N.H.

[21] Appl. No.: 08/772,991

[22] Filed: Dec. 23, 1996

[51] Int. Cl.[6] ..... B41J 2/165

[52] U.S. Cl. ..... 347/28

[58] Field of Search ..... 342/28, 30, 92; 347/28, 30, 92, 25, 36

[56] References Cited

U.S. PATENT DOCUMENTS 5,574,485 11/1996 Anderson et al. ..... 347/28

*Primary Examiner*—N. Le
*Assistant Examiner*—Thien Tran
*Attorney, Agent, or Firm*—Stephen G. Matzuk

[57] ABSTRACT

A method and apparatus for cleaning ink jet capillaries by positioning the ink jet to be cleaned in the near field stream of an opposing ink jet a providing pressurized solvent stream to precisely irrigate the ink jet to be cleaned. According to the present invention, the ink jet to be cleaned is also provided with a pressurized cleaning fluid supply, wherein both ink jets receive the corresponding pressurized solvents in selected cycles as determined by the state of the obstructing occlusion in the ink jet to be cleaned and the operator. The apparatus and method permits effective cleaning of the fine capillary ink jet openings without any applying any solid or rigid probe element to the ink jet and without submerging or surrounding the ink jet in a structure, thus providing effective cleaning while reducing or eliminating mechanical damage to the ink jet to be cleaned.

7 Claims, 4 Drawing Sheets

INK JET ASSEMBLY CAPILLARY CLEANING METHOD AND APPARATUS

FIELD OF THE INVENTION

The present invention relates to methods and apparatus for cleaning ink jet nozzles, in particular, to a method for cleaning an ink jet nozzles having a fine capillary for emitting ink jets therefrom.

BACKGROUND OF THE INVENTION

Ink jet nozzles having fine capillaries become encrusted with external build-up of dried ink and debris while also becoming occluded internally by thickened or dried ink, impurities or other obstructions larger than the capillary openings. Previous attempts to clean and refurbish such nozzles typically focus on removing the external encrustation, apply a mechanical probe to the extremely narrow (≃10 microns) capillary, or completely submerge or engulf the nozzle tip in a cleaning system, often with inadequate result. That is, the capillary is not completely opened, it is damaged, or the process is simply more trouble than the value of a new replacement nozzle.

SUMMARY OF THE INVENTION

The method and apparatus according to the present invention provides a precisely controlled irrigating stream of liquid into the tip of the occluded ink jet nozzle capillary, the stream being selectively adjusted while observing the occluding debris and while selectively applying pressure to ink supply side of the occluded nozzle capillary.

The present invention also includes a cleaning jig which provides the precise control of the application of the fluid to the nozzle tip and observation thereof. Typically, the entire of the nozzle assembly (capillary and housing) to be cleaned is removed from the printer and directly mounted in the jig and receives a directed irrigating jet of cleaning fluid from a similarly configured nozzle closely spaced to and confronting the nozzle to be cleaned.

The pressure of the applied fluid as well as pressure applied to the ink supply tube of the nozzle to be cleaned is set a predetermined level and selectively varied in combination with varying the direction of the irrigating fluid flow to dislodge the obstructing debris away from the fine opening of the ink jet nozzle tip. The variation in fluid flow direction and variations in pressure is continued to cause the dislodged debris to break up into small pieces and be expelled through the nozzle tip.

BRIEF DESCRIPTION OF THE DRAWING

These and further features of the present invention will be better understood by reading the following Detailed Description together with the Drawing, wherein.

DETAILED DESCRIPTION OF THE PRESENT INVENTION

Figure 1:
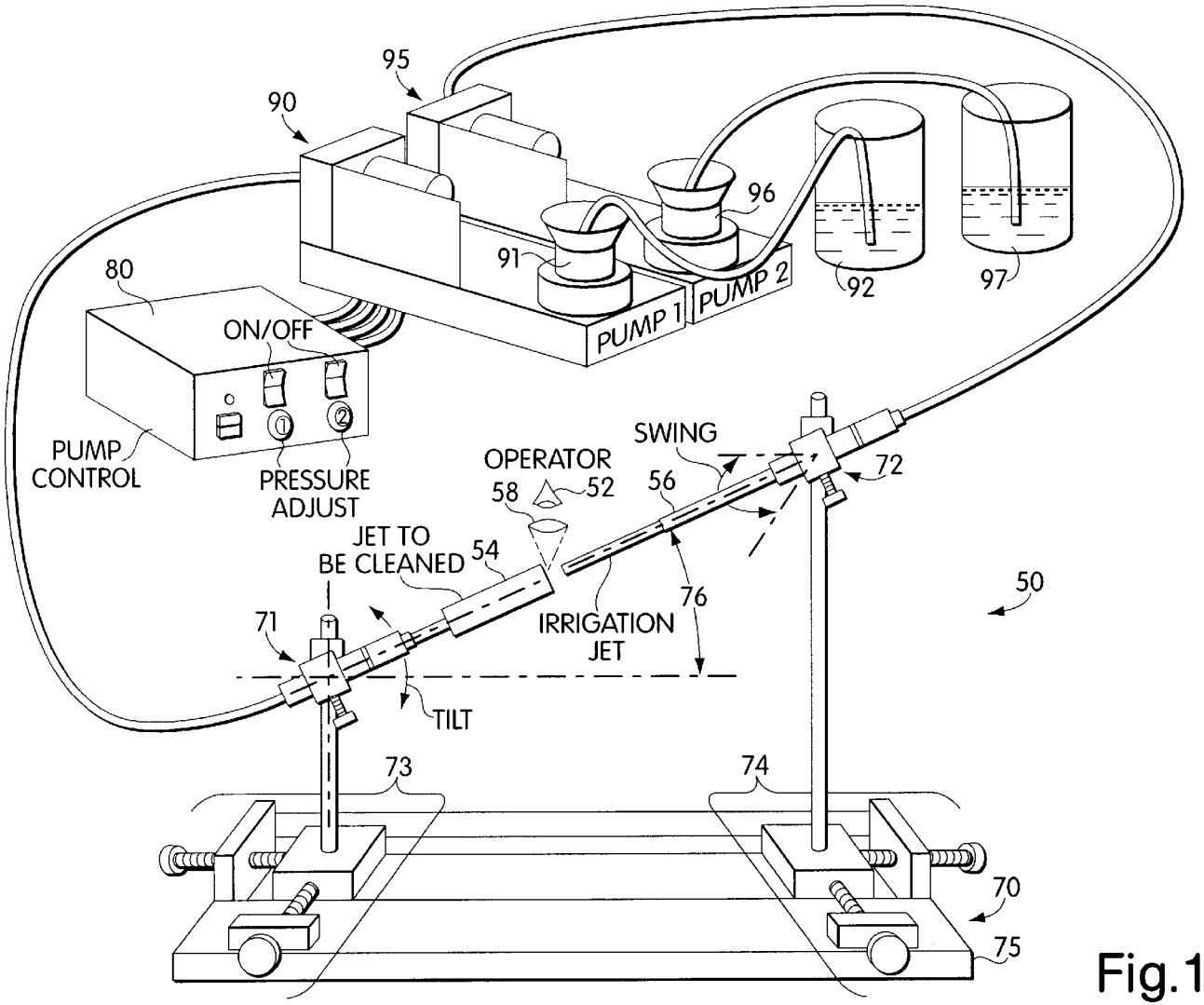
FIG. 1 is a perspective drawing of one embodiment of a cleaning jig and system according to the present invention.
Figure 4:
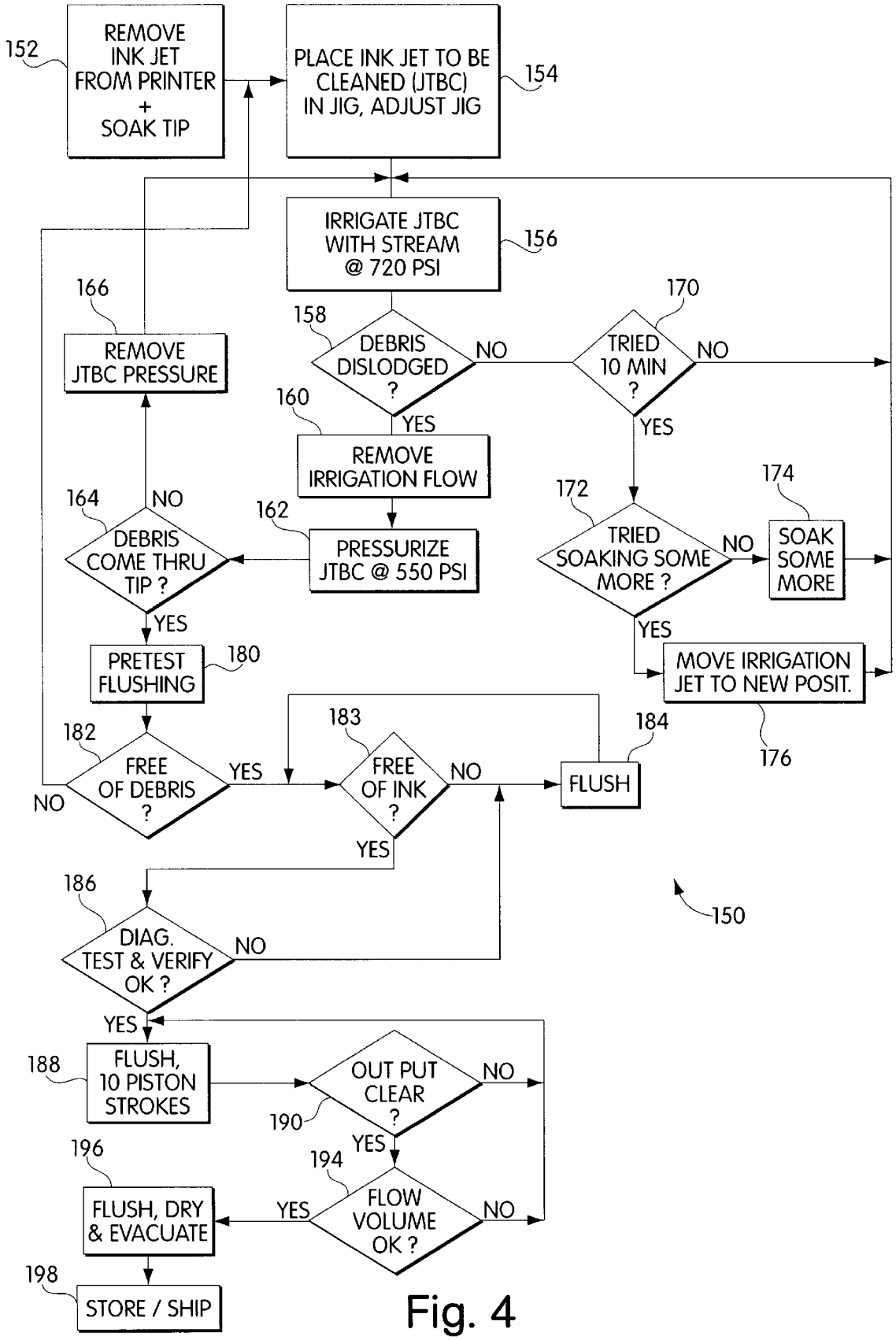
FIG. 4 is a flow chart of one embodiment of the method according to the present invention.

The cleaning method according to one embodiment of the present invention as shown in FIG. 1 and the flowchart 150 of FIG. 4, provides a cleaning system 50 wherein the operator 52 visually observes the tip 112 to be cleaned via a magnifier or microscope 58 and controls the cleaning of a ink jet capillary nozzle to be cleaned. Typically, the ink jet assembly 54 is removed in its entirety from an ink jet printer after its ink output has become unacceptable due to clogging or restriction of the ink jet capillary nozzle tip. The tip only of the ink jet capillary is initially soaked in a suitable cleaning solution (described below), step 152. The ink jet assembly 54 to be cleaned (JTBC) is mounted in a jig 70, step 154, which also holds an irrigating jet assembly 56 (typically also an ink jet assembly) with manually adjustable mounts to permit the irrigating jet assembly to be selectively positioned to apply a cleaning fluid jet into the tip and in the external vicinity of the capillary tip to be cleaned, as discussed in more detail below. Clamp mounts 71 and 72 hold the ink jet assemblies 54 and 56, respectively, to supports 73 and 74, movable in two orthogonal directions over the base 75. The clamp mounts 71 and 72 hold the ink jet assemblies 54 and 56 at a relative angle 76 to the base 75 of the jig of about 20 degrees which permits viewing of the tip 112 from above by the operator 52, and permits the orthogonal adjustment of the clamp mounts 71 and 72 to result in a movement of the irrigating fluid jet relative to the ink jet nozzle to be cleaned in a direction perpendicular to the plane of the orthogonal clamp mount adjustments. Moreover, clamp mount permits ink jet 56 to swivel laterally to change the direction of the cleaning fluid flow and to discontinue the flow against the tip 112 in lieu of powering down the pump 95.

The ink jet assemblies are supplied with selectively pressurized flows of cleaning fluid from pumps 90 and 95, which are controllable by a pump control 80 having on/off and pressure selector controls for each pump 90 and 95. The pumps include fluid supplies (cups 91 and 96) which draw from larger cleaning fluid reservoirs 92 and 97, respectively.

Figure 2:
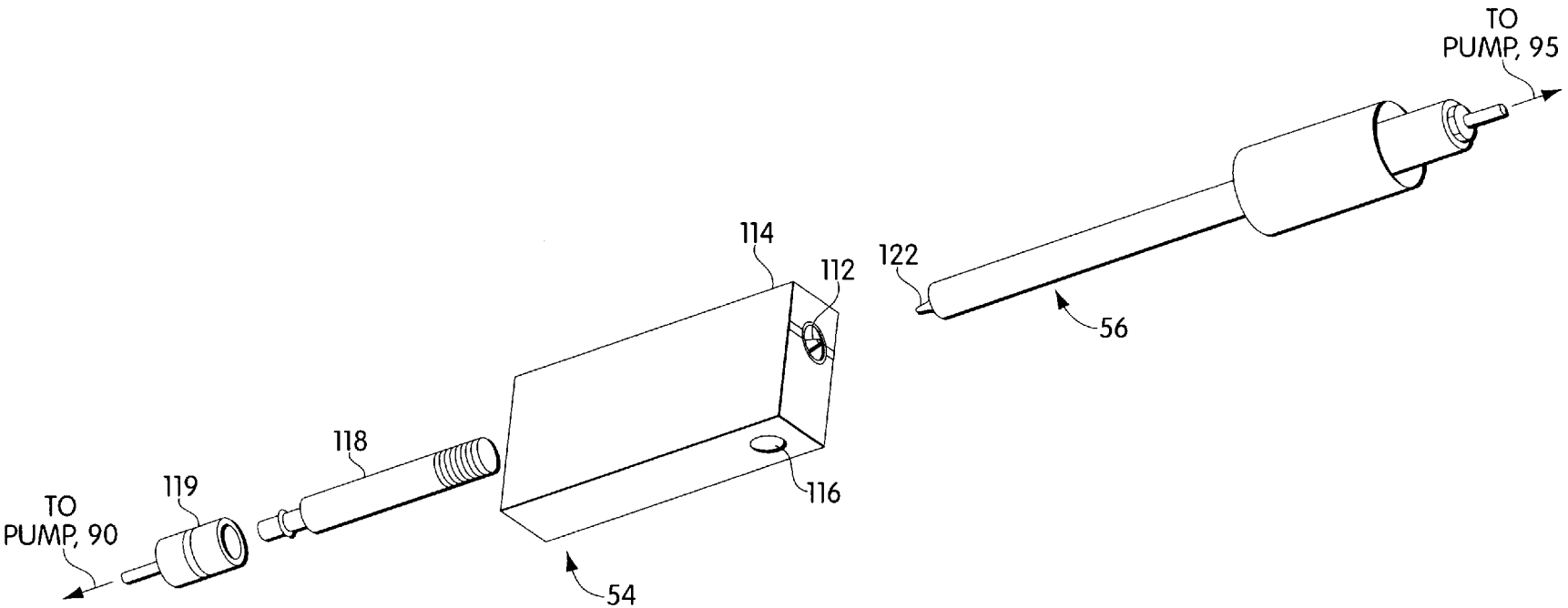
FIG. 2 is a perspective drawing showing the alignment of the nozzle to be cleaned with the nozzle applying the cleaning fluid.

A closer, perspective view of the cleaning system 50 is shown in FIG. 2, which provide an illustration of the substantial axially alignment of the capillary nozzle tips 112 and 122 of the ink jets 54 and 56, respectively. The exemplary ink jet to be cleaned 54 includes a rectangular housing 114 and a drain aperture 116 therein as may be provided for the particular ink jet printer from which the ink jet 54 has been removed. Other housing configurations may be incorporated for use according to the present invention. The ink jet 54 is connected to the pump 90 via fittings 118, 119, which typically include a "quick connect" coupling for easy connection and disconnection. The irrigating ink jet 56 comprises an ink jet assembly having a cylindrical housing 124; other housing configurations are within the scope of the present invention. Moreover, according to the present invention, the ink jet 56 may comprise another source of cleaning fluid having an irrigating stream width substantially equal or less than the capillary opening of the ink jet to be cleaned, 54.

Figure 3A:
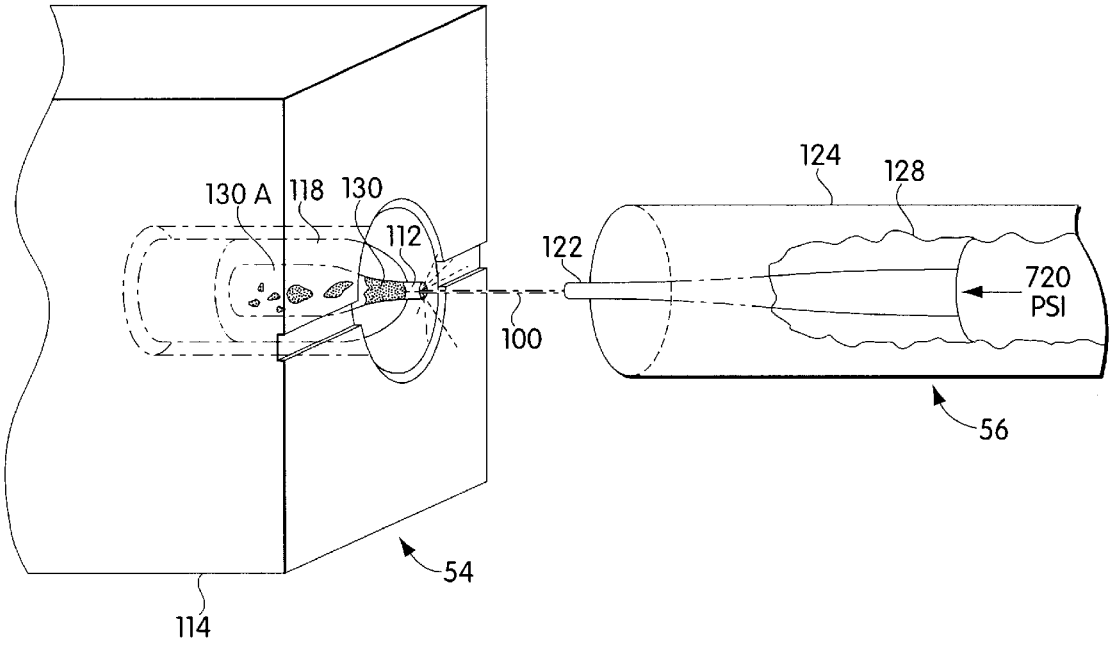
FIGS. 3A and 3B are perspective drawings of the regions immediately surrounding the nozzle to be cleaned showing initial and final stages in the cleaning process according to one embodiment of the present invention.
Figure 3B:
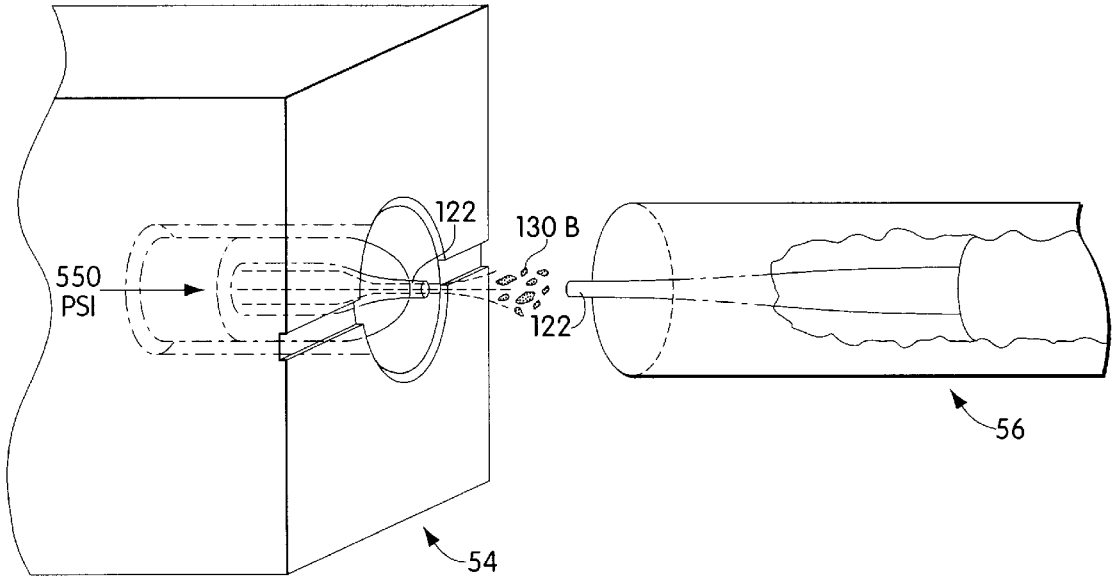

A further detailed perspective of the confronting ink jets 54 and 56 is shown in FIGS. 3A and 3B, wherein a continuous stream of cleaning fluid, such as a solution of alcohol, distilled water and a biocide, e.g. phenonip, and a surfactant, e.g. butyldiglycol is initially directed to the opening of the capillary nozzle opening to be cleaned by operation of the clamp mounts 71 and 72, to dislodge the occluding debris 130, step 156. Typically, the tips 112 and 122 are partially enclosed by plastic oblong hemispherical covers, 118 and 128, respectively. The pressure of the cleaning fluid is set near the maximum tip pressure, typically 720 PSI for the present embodiment (turned on and off as discussed below) to provide a continuous (non-atomized) cleaning fluid flow to the tip 112, and is supplied by pump 95 as adjusted by the pump control 80. The supports 73 and/or 74 are adjusted to cause the fluid stream 100 to cause a movement of the debris 130 within the capillary nozzle as observed by the operator 52.

If the debris remains lodged within the tip 112, at step 158, and irrigation has continued for a moderate length of time, e.g. 10 minutes, step 170, and additional soaking has not been tried, step 172, the tip is soaked in cleaning solution, step 174, and again irrigated, step 156. If the additional soaking appears ineffective, the stream 100 is moved (e.g. off-center) from the tip 114 opening, step 176, to cause maximum effective impact on the debris 130 until it becomes dislodged, 130A.

When the debris becomes dislodged, 130A and step 158, the irrigating fluid stream 100 pressure is reduced or discontinued, step 160. Thereafter, a pressure of cleaning fluid on the other side of the debris 130 is maintained at the ink jet 54 by cleaning fluid supplied by pump 90, step 162. The pressure of cleaning fluid supplied by pump is selected to be near the average jet pressure, typically about 550 PSI when an ink jet having an opening of 10 microns is being cleaned. If the debris is dislodged, but is not reduced in size, broken up or changed (e.g. into a thick liquid) so as to be able to pass through the tip 112, step 164, the ink jet 54 pressure is discontinued, step 166 and irrigation reapplied, step 156, and if necessary, reapplied repeatedly until the debris 130A breaks into small enough pieces or changes enough to flow through the tip 140 opening, as shown in FIG. 3B. Thereafter, the fluid stream may be directed by supports 73, 74 to selectively clean the exterior surfaces of the tip 112 to remove dried ink, paper fibre and other residue.

According to the embodiment shown, the ink jet 56 tip is sufficiently close to the ink jet 54 tip to present a fluid 100 flow width sufficiently confined as to provide a significant flow backwards through the end of the tip 112 to impact and dislodge the debris 130.

If it observed by the operator that the debris has come out through the tip 112, the ink jet capillary is flushed with more cleaning fluid to make sure no other remnant of debris or dye has settled within the ink jet 54, step 180; preferably the irrigation of the ink jet assembly is discontinued and the ink jet tip 112 is angled down toward the jig base 75 while it is being flushed. The flushing continues until it is free of debris and can pass about 10 cc/min. of cleaner, steps 182, and if not, the ink jet is remounted in the jig 154 and the next piece of debris is removed. The tip must also be free of ink, step 183, and flushed if it is not, step 184. The ink jet is then mounted into a test printer where diagnostic pressure, electrical, printing and other diagnostic tests, such as a flow of 0.227 cc/min (±10 percent) of ink, are performed, step 186; if a test fails, the ink jet 54 is again flushed, step 184, and the tests repeated, step 186, until the unit passes. There-after, the ink jet 54 is removed from the test printer and flushed with cleaning fluid, step 188 until the jet output is clear and 50 cc of cleaning fluid is pumped from the jet, step 190; if this is not achieved, it is again flushed, step 188 and rechecked at step 190. Thereafter, the ink flow of 0.227 cc/min is checked, step 194. The ink jet is then flushed again with cleaning fluid, dried and evacuated, step 196, before it is stored or shipped, step 198.

Modifications and substitutions made by one of ordinary skill in the art are within the scope of the present invention which is not to be limited except by the claims which follow.

Also included within the scope of the present invention is automation of the method and apparatus according to the present invention, such as by automatically varying the manual adjustments with computer servo controllers having corresponding sensors to monitor and automate the embodiment according to the present invention. Moreover, the method according to the present invention may be applied to the ink jet before it is completely occluded. Other cleaning solutions and irrigating ink jets may be provided according to the present invention.

What is claimed is:

1. A Method for cleaning a printer ink jet assembly, wherein said ink jet includes a capillary tube having an orifice through which ink is ejected toward a surface and in which occluding obstructions are formed, comprising the steps of:

positioning said capillary tube of said ink jet assembly to receive an externally applied fluid stream having a high velocity and limited cross section approximately equal to said orifice;

applying said fluid stream to said orifice; and applying a selected pressure to said capillary to cause said obstructions to become dislodged.

2. The Method of claim 1, wherein said step of applying a selected pressure comprises the step of selectively applying alternating positive and negative pressure.

3. The Method of claim 1, wherein the step of applying a fluid stream comprises the step of applying a fluid stream from a confronting capillary type ejector.

4. The Method of claim 3, wherein the step of positioning includes the step of positioning said ink jet capillary tube sufficiently proximal to said confronting ejector to receive a continuous fluid stream.

5. The Method of claim 1, further including the step of selectively applying a fluid pressure to said printer ink jet assembly to cause said debris to become ejected through said orifice.

6. Apparatus for cleaning an ink jet assembly capillary tube having an orifice and an occluding obstruction, comprising:

means for providing a cleaning fluid stream having a width substantially equal to or less than said orifice and having a selectable pressure;

means for positioning said capillary tube of said ink jet assembly relative to said means for providing a cleaning fluid stream;

a confronting fluid jet for applying said fluid stream to said orifice; and means for applying a selective pressure to said capillary tube, wherein said means for applying a selective pressure acts in concert with said externally applied fluid stream, and wherein said means for providing a cleaning fluid stream pressure and said means for positioning said ink jet selectively varies said pressure and position of said cleaning fluid to cause said occluding obstruction to become dislodged from said capillary tube.

7. The Apparatus of claim 6, wherein said means for applying a selective pressure to said capillary tube includes a controllable pump for selectively pressurizing said ink jet capillary tube.

* * * * *